US008519900B2

(12) United States Patent
Chen

(10) Patent No.: US 8,519,900 B2
(45) Date of Patent: Aug. 27, 2013

(54) GLOBAL POSITIONING SYSTEM ANTENNA

(75) Inventor: Hsi-Chieh Chen, Tu-Cheng (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 435 days.

(21) Appl. No.: 12/890,697

(22) Filed: Sep. 26, 2010

(65) Prior Publication Data

US 2012/0001817 A1 Jan. 5, 2012

(30) Foreign Application Priority Data

Jun. 30, 2010 (TW) ..... 99121477

(51) Int. Cl.
*H01Q 13/10* (2006.01)

(52) U.S. Cl.
USPC ..... 343/767

(58) Field of Classification Search
USPC ..... 343/767
See application file for complete search history.

(56) References Cited

U.S. PATENT DOCUMENTS

| | | | | |
|---|---|---|---|---|
| 6,894,646 | B2 * | 5/2005 | Washiro et al. | 343/700 MS |
| 7,091,911 | B2 * | 8/2006 | Qi et al. | 343/702 |
| 8,009,119 | B2 * | 8/2011 | Hung | 343/893 |
| 8,013,796 | B2 * | 9/2011 | Liu et al. | 343/702 |

* cited by examiner

*Primary Examiner* — Jerome Jackson, Jr.
*Assistant Examiner* — Hai Tran
(74) *Attorney, Agent, or Firm* — Altis Law Group, Inc.

(57) ABSTRACT

A global positioning system antenna includes a radiator. The radiator includes a base section, an extension section connected to an edge of the base section, a first curved section connected to an edge of the extension section, and a second curved section connected to a distal end of the first curved section. The first curved section and the base section define a slot therebetween. The second curved section defines a first gap and a second gap thereon. The first gap and the second gap face each other.

14 Claims, 2 Drawing Sheets

GLOBAL POSITIONING SYSTEM ANTENNA

BACKGROUND

1. Technical Field

The present disclosure relates to antennas, and particularly, to a global positioning system antenna.

2. Description of Related Art

Portable devices such as mobile phones, personal digital assistants (PDA) and laptop computers are widely used. Global positioning system antennas can be installed in such portable devices to receive/send wireless signals. However, most antennas have complicated structure and are large, compromising most current efforts toward device size conservation. However, if miniaturized antennas can be installed in the portable devices, communication quality of the portable devices may suffer.

Therefore, a global positioning system antenna is desired that can overcome the limitations described.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
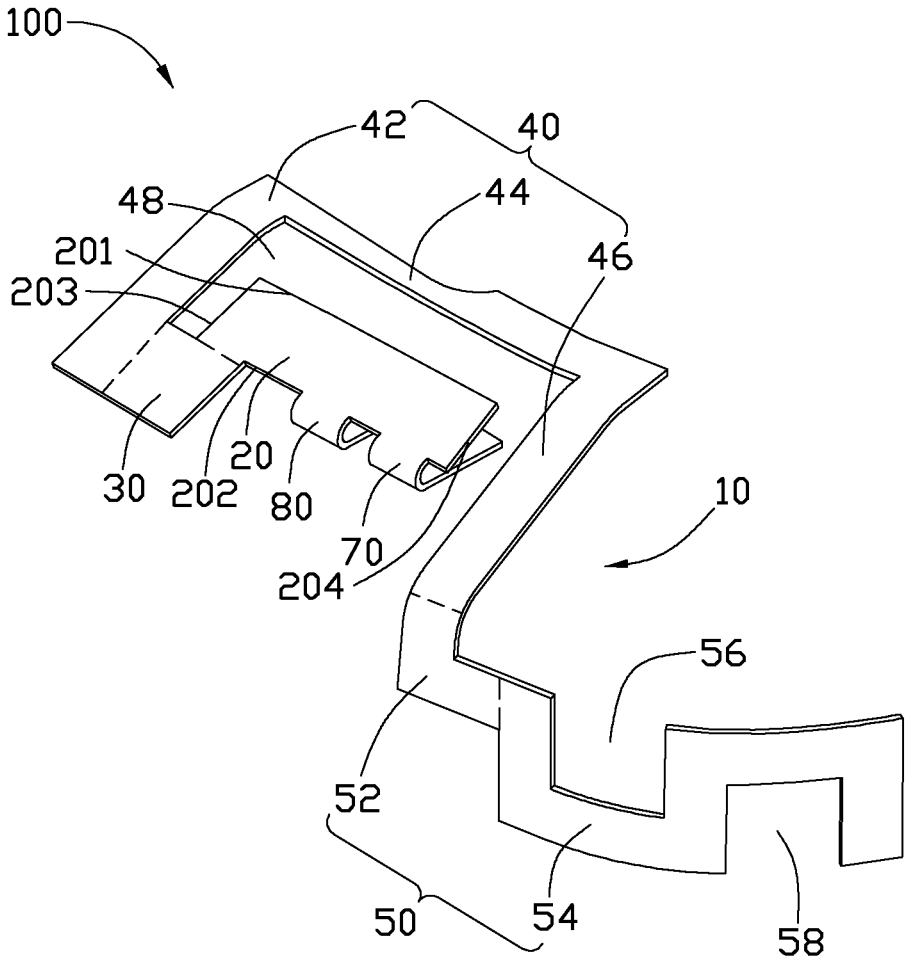
FIG. 1 is an isometric view of a global positioning system antenna according to an exemplary embodiment.
Figure 2:
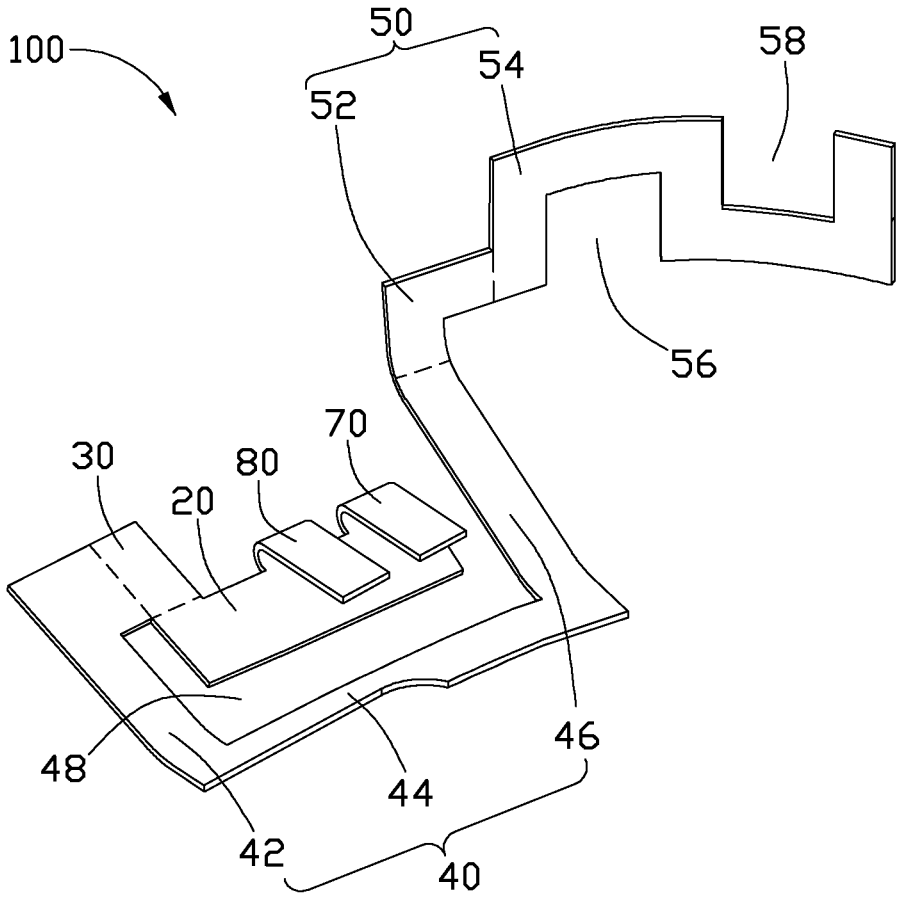
FIG. 2 is an isometric view of FIG. 1, but viewed from another aspect.

Referring to FIGS. 1-2, an exemplary embodiment of a global positioning system (GPS) antenna 100 includes a radiator 10, a feed portion 70, and a ground portion 80. The GPS antenna 100 can be used in a portable electronic device, such as a mobile phone, a personal digital assistant (PDA), and others. The GPS antenna 100 is a flexible printed circuit (FPC).

The radiator 10 includes a base section 20, an extension section 30, a first curved section 40 and a second curved section 50, connected in that order. The extension section 30 and the first curved section 40 are substantially coplanar with the base section 20, and the second curved section 50 is substantially non-coplanar with the base section 20.

The base section 20 and the extension section 30 are rectangular plates. The base section 20 includes a first edge 201, a second edge 202, a third edge 203, and a fourth edge 204. The third edge 203 and the fourth edge 204 are connected to two opposite ends of the first edge 201 and the second edge 202, respectively. The extension section 30 extends from the second edge 202 at a position adjacent to the third edge 203. The feed portion 70 and the ground portion 80 both extend from the second edge 202, and are located between the extension section 30 and the fourth edge 204. One end of the extension section 30 partially connects to the second edge 202 of the base section 20, and the other end of the extension section 30 extends away from the base section 20.

The first curved section 40 is substantially a U-shaped plate and includes a first connection section 42, a second connection section 44, and a third connection section 46. The first connection section 42 connects to an edge of the extension section 30, and extends opposite from the extension section 30. The second connection section 44 connects the first connection section 42 and the third connection section 46. The second connection section 44 is substantially perpendicular to the first connection section 42 and the third connection section 46. The second connection section 44 is longer than the base section 20. The first curved section 40 and the base section 20 define a slot 48 therebetween. In the illustrated embodiment, the slot 48 is substantially L-shaped. The third connection section 46 and the first connection section 42 are positioned corresponding to each other, and the third connection section 46 is longer than the first connection section 42.

A plane of the second curved section 50 is substantially perpendicular to a plane of the first curved section 40. The second curved section 50 includes a transition section 52 and an elongation section 54 connected to the transition section 52. The transition section 52 is substantially a L-shaped plate and connects to a distal end of the third connection section 46. The elongation section 54 may be, for example, an arcuate plate or a flat plate. In the illustrated embodiment, the elongation section 54 is shown as the arcuate plate. The elongation section 54 defines a first gap 56 and a second gap 58 thereon. The first gap 56 and the second gap 58 are square. An direction of the first gap 56 and the second gap 58 face each other. Accordingly, the elongation section 54 is substantially square wave period shaped.

The feed portion 70 is substantially hook-shaped and connects to the edge of the base section 20 away from the slot 48. A plane of the feed portion 70 and the plane of the first curved section 40 form an angle. The feed portion 70 electrically connects to a feed point of a system signal of a circuit board of the portable electronic device (not shown).

The ground portion 80 is substantially hook-shaped and connects to the edge of the base section 20 away from the slot 48. The ground portion 80 is parallel to the feed portion 70. A plane of the ground portion 80 and the plane of the first curved section 40 form an angle. The ground portion 80 electrically connects to a ground point of the circuit board of the portable electronic device (not shown).

In assembly of the GPS antenna 100 to the portable electronic device, the radiator 10 abuts an inner surface of the portable electronic device. An angle between the first curved section 40 and the second curved section 50 can be adjusted according to the demands of a housing of the portable electronic device, for conserving space. The feed portion 70 abuts the feed point of the portable electronic device, and the ground portion 80 abuts the ground point of the portable electronic device. When the feed portion 70 receives a signal, a current path is formed on the radiator 10. A length of the current path is about 48 mm.

When the GPS antenna 100 operates, a resonant frequency thereof ranges from about 1570 MHz to 1580 MHz, commensurate with the general frequency of GPS satellite signals. Table 1 shows a maximum gain and a radiation efficiency of the GPS antenna 100 with respective frequencies, with the GPS antenna 100 meeting the general design requirements for antennas.

TABLE 1

| Frequency (MHz) | Gain (dB) | Efficiency (%) |
|---|---|---|
| 1570 | −3.7 | 42.2 |
| 1575 | −3.7 | 42.5 |
| 1580 | −3.8 | 41.4 |

While the invention has been described by way of example and in terms of preferred embodiment, it is to be understood that the invention is not limited thereto. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A global positioning system antenna, comprising:

a radiator comprising:

a base section comprising a first edge, a second edge, a third edge, and a fourth edge, wherein the third edge and the fourth edge are connected to two opposite ends of the first edge and the second edge;

an extension section connected to the second edge of the base section at a position adjacent to the third edge;

a first curved section connected to an edge of the extension section, wherein the first curved section and the base section define a slot therebetween;

a second curved section connected to a distal end of the first curved section, wherein the second curved section defines a first gap and a second gap thereon, and wherein a direction of the first gap and the second gap face each other;

a feed portion; and a ground portion, wherein the feed portion and the ground portion extend from the second edge and are located between the extension section and the fourth edge.

2. The global positioning system antenna of claim 1, wherein the extension section and the first curved section are substantially coplanar with the base section, and the second curved section is substantially non-coplanar with the base section.

3. The global positioning system antenna of claim 1, wherein the first curved section comprises a first connection section, a second connection section, and a third connection section, the first connection section connecting to an edge of the extension section and extending opposite from the extension section, and wherein the second connection section connects the first connection section to the third connection section.

4. The global positioning system antenna of claim 3, wherein the second connection section is substantially perpendicular to the first connection section and the third connection section, the second connection section is longer than the base section, and the third connection section is longer than the first connection section.

5. The global positioning system antenna of claim 3, wherein the second curved section comprises a transition section and an elongation section connected to the transition section, and wherein the transition section is substantially an L-shaped plate and connected to a distal end of the third connection section, and wherein the first gap and the second gap are defined on the elongation section.

6. The global positioning system antenna of claim 5, wherein the elongation section is substantially square wave period shaped, and wherein the elongation section is an arcuate plate or a flat plate.

7. The global positioning system antenna of claim 1, wherein the feed portion is away from the slot, the feed portion is substantially hook-shaped, and a plane of the feed portion and a plane of the first curved section form an angle.

8. The global positioning system antenna of claim 1, wherein the ground portion is away from the slot, the ground portion is substantially hook-shaped and parallel to the feed portion, and a plane of the ground portion and the plane of the first curved section form an angle.

9. The global positioning system antenna of claim 1, wherein the slot is substantially L-shaped.

10. The global positioning system antenna of claim 1, wherein the first gap and the second gap are square.

11. The global positioning system antenna of claim 1, wherein the global positioning system antenna is a flexible printed circuit (FPC).

12. The global positioning system antenna of claim 1, wherein the base section and the extension section are rectangular plates.

13. The global positioning system antenna of claim 1, wherein the first curved section is a substantially U-shaped plate.

14. The global positioning system antenna of claim 1, wherein a plane of the second curved section is substantially perpendicular to a plane of the first curved section.

* * * * *